US010813434B2

(12) United States Patent
Crane et al.

(10) Patent No.: US 10,813,434 B2
(45) Date of Patent: Oct. 27, 2020

(54) APPLICATOR FOR APPLYING COSMETIC COMPOSITIONS

(71) Applicant: L'OREAL, Paris (FR)

(72) Inventors: Christine Marie Crane, Watchung, NJ (US); Mikhail Motornov, Clark, NJ (US); Gracemarie Rose Papaleo-Trombetta, Staten Island, NY (US); Ludovic Lecaro, Morristown, NJ (US); Patrick Jouffret, Toulon (FR); Noemie Chaillet Piquand, Paris (FR); Balanda Atis, Newark, NJ (US); Anke Hadasch, Jersey-City, NJ (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/080,398

(22) PCT Filed: Mar. 9, 2017

(86) PCT No.: PCT/US2017/021554

§ 371 (c)(1),
(2) Date: Aug. 28, 2018

(87) PCT Pub. No.: WO2017/156257

PCT Pub. Date: Sep. 14, 2017

(65) Prior Publication Data

US 2019/0059558 A1 Feb. 28, 2019

Related U.S. Application Data

(63) Continuation of application No. 15/395,608, filed on Dec. 30, 2016.

(Continued)

(51) Int. Cl.

| | |
|---|---|
| ***B43M 11/06*** | (2006.01) |
| ***A45D 40/26*** | (2006.01) |
| ***A46B 11/00*** | (2006.01) |

(52) U.S. Cl.

CPC ..... *A45D 40/262* (2013.01); *A46B 11/002* (2013.01); *A45D 2200/1018* (2013.01); *A46B 2200/1053* (2013.01)

(58) Field of Classification Search

CPC ..... A45D 40/262; A46B 2200/1053; A46B 11/002

(Continued)

(56) References Cited

U.S. PATENT DOCUMENTS 5,137,038 A * 8/1992 Kingsford ..... A45D 40/265 132/218
6,053,177 A * 4/2000 Sofer ..... A45D 24/28 132/112

(Continued)

FOREIGN PATENT DOCUMENTS

CN 101589883 A * 12/2009
KR 20-2009-0005669 U 6/2009

OTHER PUBLICATIONS

International Search Report and Written Opinion of the International Searching Authority dated Jun. 19, 2017, in PCT/US2017/021554 filed Mar. 9, 2017.

*Primary Examiner* — Jennifer C Chiang
(74) *Attorney, Agent, or Firm* — Oblon, McClelland, Maier & Neustadt, L.L.P.

(57) ABSTRACT

A cosmetic applicator includes a container that stores a cosmetic composition, an applicator head having a linear or non-linear shape with a proximal end and a distal end, and a plurality of holes along or around the circumference of the applicator head, the distal end connected to the container. Further, the cosmetic applicator includes a plurality of slits along or around the circumference of the applicator head, the distal end connected to the container.

17 Claims, 18 Drawing Sheets

Related U.S. Application Data

(60) Provisional application No. 62/305,856, filed on Mar. 9, 2016.

(58) Field of Classification Search
USPC ..... 401/126, 183
See application file for complete search history.

(56) References Cited

U.S. PATENT DOCUMENTS

| | | | | |
|---|---|---|---|---|
| 7,384,208 | B2 | 6/2008 | Bouix et al. | |
| 7,500,801 | B2 | 3/2009 | Chu et al. | |
| 8,245,716 | B2 | 8/2012 | Malvar et al. | |
| 9,125,470 | B2 * | 9/2015 | Thiebaut | A45D 34/04 |
| 9,247,805 | B1 * | 2/2016 | Malm | A46B 11/0079 |
| 2006/0137999 | A1 | 6/2006 | Williams | |
| 2009/0119859 | A1 * | 5/2009 | Podolsky | A46B 11/002 15/167.1 |
| 2013/0205524 | A1 * | 8/2013 | Dhami | A46B 5/0095 15/104.94 |
| 2014/0052111 | A1 * | 2/2014 | Odermatt | A61M 1/008 604/543 |
| 2016/0135569 | A1 * | 5/2016 | Caulier | A46B 3/005 401/129 |

* cited by examiner

| Series | ID | Hole H1 (mm) | Hole H2 (mm) | Hole H3 (mm) | Hole H4 (mm) | Hole H5 (mm) | Hole H6 (mm) | Hole H7 (mm) | Orientation |
|---|---|---|---|---|---|---|---|---|---|
| S100 | S101 | 1 | - | 0.9 | - | 0.8 | - | 0.7 | In-line |
| | S103 | 1.4 | - | 1.3 | - | 1.2 | - | 1.1 | In-line |
| | S104 | 0.8 | - | 0.8 | - | 0.8 | - | 0.8 | In-line |
| S200 | S201 | 1 | 0.95 | 0.9 | 0.85 | 0.8 | 0.75 | 0.7 | In-line |
| | S204 | 0.8 | 0.8 | 0.8 | 0.8 | 0.8 | 0.8 | 0.8 | In-line |
| S300 | S301 | 1 | 0.95 | 0.9 | 0.85 | 0.8 | 0.75 | 0.7 | Zig-zag |
| | S303 | 1.4 | - | 1.3 | - | 1.2 | - | 1.1 | Zig-zag |
| | S304 | 0.8 | 0.8 | 0.8 | 0.8 | 0.8 | 0.8 | 0.8 | Zig-zag |
| S700 | S703 | 1.8 | - | 1.7 | - | 1.6 | - | 1.5 | In-line |

FIG. 6

Details of D

APPLICATOR FOR APPLYING COSMETIC COMPOSITIONS

CROSS REFERENCE TO RELATED APPLICATIONS

The present application claims the benefit of priority to U.S. Provisional Application No. 62/305,856, filed Mar. 9, 2016, and U.S. Non-Provisional application Ser. No. 15/395,608, filed on Dec. 30, 2016. The entire contents of which is hereby incorporated by reference.

FIELD OF THE INVENTION

The present disclosure relates generally to applicators for applying cosmetic compositions to keratinous material, in particular to applicators containing a plurality of holes and associated cosmetic compositions for application to hair, eyebrows and/or eyelashes.

BACKGROUND OF THE INVENTION

Cosmetic compositions for making up keratinous materials such as eyebrows and/or eyelashes (mascaras) typically are marketed in a system including a reservoir in which the composition is stored together with a brush for applying the composition to eyebrows and/or eyelashes. Application of such mascaras occurs by placing the brush into the reservoir, coating the brush with mascara, withdrawing the brush from the reservoir, and applying the mascara to eyebrows and/or eyelashes. This can be a problematic process.

More specifically, traditional mascara applicators typically include a slender brush having a cap on one end that provides a handle, which may be threaded upon the neck of a container with the brush located within the mascara. In operation, the cap on the end of the brush is unscrewed from the container neck with one hand, and the brush is removed bearing a supply of mascara on its bristles. The user may then stroke the mascara-laden bristles upon the eyelashes, and upon completion of the application replace the brush back with its bristles housed within the container and its supply of mascara. Such applicators are not as well-suited for a single hand operation and application.

Further, the shape and orientation of brush bristles of the applicator are normally fixed. Therefore, where the design of the brush applicator is well-suited for applying mascara to the lashes of one eye with one hand, they are inherently not as well suited for applying mascara with the same hand to the other eye. For instance, an applicator that has a generally cylindrical, peripheral surface of its brush bristles is better-suited for applying mascara to the central portion of the lashes than to the end portions. In contrast, where the applicator has a conical shape of bristles, with the apex of the conical mass located at the tip of the brush, the brush is well suited for applying with the right hand mascara to right eyelashes, while it is ill-suited for applying mascara to the left eye lashes unless a hand switch is made.

Additionally, for the above described mascara applicators, the user needs to frequently dip the brush in the container supply to secure more mascara on the bristles before further application. Such a frequent dip and apply process may lead to an uneven amount of mascara being transported to the brush bristles, which may result in an uneven application of the mascara.

The result of the above limitations of mascaras is that many consumers forego using mascaras, opting to avoid the often difficult application process.

Thus, there remains a need for improved cosmetic compositions for application to keratinous materials such as mascaras having improved application properties.

Accordingly, one aspect of the present invention is a care and/or makeup and/or treatment system for keratinous material which includes a cosmetic composition having good cosmetic properties such as, for example, long-wearing, easy to remove, possesses good anti-flaking properties and/or possess good anti-smudging properties, where the system allows easy application of the composition to keratinous material.

SUMMARY OF THE INVENTION

The present invention relates to a applicator for applying a cosmetic composition to a keratinous material comprising a cosmetic applicator and a cosmetic composition. The cosmetic applicator includes a container configured to store the cosmetic composition, an applicator head having a linear or non-linear orientation such as a curved, bent or conical shape with a proximal end and a distal end, and a plurality of holes along or around the circumference of the applicator head, the distal end connected to the container. Preferably, the container is deformable and/or the applicator head is flocked with flocking extending on a portion of the applicator head, extending over a circumference of the applicator head or extending completely around the circumference of the applicator head, and covering or exposing the plurality of holes. Preferably, the cosmetic composition is a mascara and/or the keratinous material is hair, eyebrows and/or eyelashes.

The present invention relates to a applicator for applying a cosmetic composition to a keratinous material comprising a cosmetic applicator and a cosmetic composition. The cosmetic applicator includes a deformable container configured to store the cosmetic composition, an applicator head having a linear or non-linear orientation such as a curved, bent or conical shape with a proximal end and a distal end, and a plurality of holes along or around the circumference of the applicator head, the distal end connected to the deformable container. Preferably, the applicator head is flocked with flocking extending on a portion of the applicator head, extending over a circumference of the applicator head or extending completely around the circumference of the applicator head, and covering or exposing the plurality of holes. In response to a deformation force applied to the deformable container, the deformable container transports the cosmetic composition to the applicator head and further to the flocked brush (if present) via the plurality of holes for application to the keratinous material. Preferably, the cosmetic composition is a mascara and/or the keratinous material is hair, eyebrows and/or eyelashes.

The present invention relates to a applicator for applying a cosmetic composition to a keratinous material comprising a cosmetic applicator and a cosmetic composition. The cosmetic applicator includes a cylindrical container (deformable or non-deformable) configured to store the cosmetic composition, an applicator head having a linear or non-linear orientation such as a curved, bent or conical shape with a proximal end and a distal end, and a plurality of holes along or around the circumference of the applicator head, the distal end connected to the cylindrical container. Preferably, the applicator head is flocked with flocking extending on a portion of the applicator head, extending over a circumference of the applicator head or extending completely around the circumference of the applicator head, and covering or exposing the plurality of holes. In response to a dispensing force applied to the cylindrical container, the cylindrical container transports the cosmetic composition to the applicator head and further to the flocked brush (if present) via the plurality of holes. Preferably, the cosmetic composition is a mascara and/or the keratinous material is hair, eyebrows and/or eyelashes.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings:

FIG. 6 is a table listing exemplary dimension of holes of a heads of an applicator according to an exemplary embodiment of the present disclosure.

DETAILED DESCRIPTION OF THE INVENTION

Figure 1:
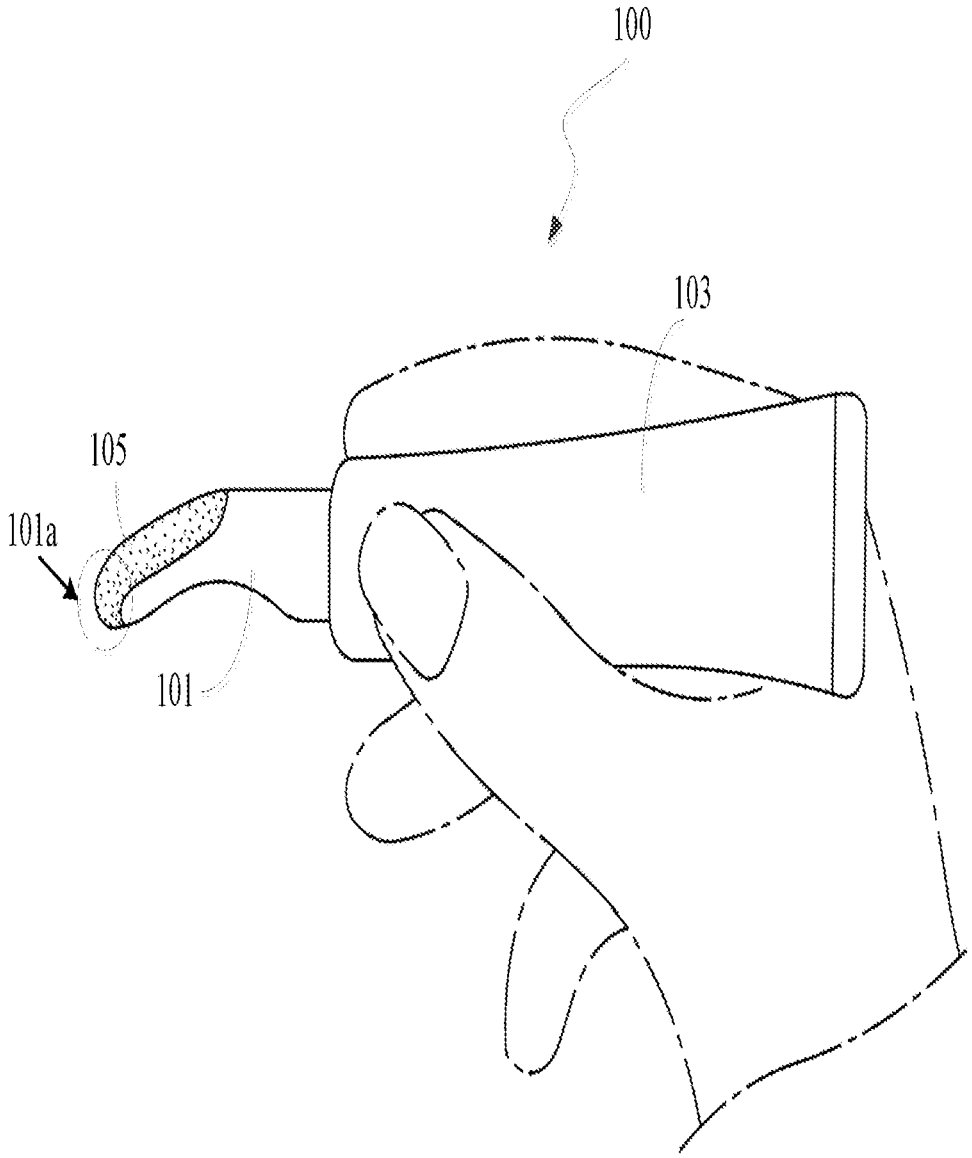
FIG. 1 illustrates according to an embodiment, an exemplary mascara tube including a flocked applicator according to an exemplary embodiment of the present disclosure.

In the following description of the invention and the claims appended hereto, it is to be understood that the terms used have their ordinary and accustomed meanings in the art, unless otherwise specified.

"About" as used herein means within 10% of the indicated number (e.g. "about 10%" means 9%-11% and "about 2%" means 1.8%-2.2%).

"A" or "an" as used herein means "at least one."

As used herein, all ranges provided are meant to include every specific range within, and combination of subranges between, the given ranges. Thus, a range from 1-5, includes specifically 1, 2, 3, 4 and 5, as well as subranges such as and 2-5, 3-5, 2-3, 2-4, 1-4, etc.

Referred to herein are trade names for materials including, but not limited to polymers and optional components. The inventors herein do not intend to be limited by materials described and referenced by a certain trade name. Equivalent materials (e.g., those obtained from a different source under a different name or catalog (reference) number) to those referenced by trade name may be substituted and utilized in the methods described and claimed herein.

Furthermore, where a range of values is provided, it is to be understood that each intervening value between an upper and lower limit of the range and any other stated or intervening value in that stated range is encompassed within the disclosure. Where the stated range includes upper and lower limits, ranges excluding either of those limits are also included.

The following disclosure is to aid the reader in understanding the present invention, but it is not intended to vary or otherwise limit the meaning of the invention or terms/phrases describing the invention.

Cosmetic Applicator

According to the present invention, a cosmetic applicator comprising a container configured to store the cosmetic composition, an applicator head having a linear or non-linear orientation such as a curved, bent or conical shape with a proximal end and a distal end, and a plurality of holes along or around the circumference of the applicator head, the distal end connected to the container is provided. According to preferred embodiments, the cosmetic applicator further comprises a flocked brush with flocking extending on a portion of the applicator head, extending over a circumference of the applicator head or extending completely around the circumference of the applicator head, and covering or exposing the plurality of holes.

According to preferred embodiments, the container is a deformable container. In accordance with this embodiment of the present invention, in response to a deformation force applied to the deformable container, the container transports the cosmetic composition to the applicator head for application to keratinous material. According to preferred embodiments, the cosmetic applicator further comprises a flocked brush with flocking extending on a portion of the applicator head, extending over a circumference of the applicator head or extending completely around the circumference of the applicator head, and covering or exposing the plurality of holes and the deformation force further transports the cosmetic composition to the flocked brush via the plurality of holes for application to the keratinous material.

According to preferred embodiments, the container is a cylindrical container having a depressible element such as, for example, a piston or a plunger. According to this embodiment, the container may be deformable or non-deformable. In accordance with this embodiment of the present invention, in response to a dispensing force applied to the container and/or depressible element, the container transports the cosmetic composition to the applicator head for application to keratinous material. According to preferred embodiments, the cosmetic applicator further comprises a flocked brush with flocking extending on a portion of the applicator head, extending over a circumference of the applicator head or extending completely around the circumference of the applicator head, and covering or exposing the plurality of holes and the dispensing force further transports the cosmetic composition to the flocked brush via the plurality of holes for application to the keratinous material.

As indicated above, according to preferred embodiments of the present invention, the cosmetic applicator comprises a flocked brush for applying the cosmetic composition (e.g., mascara). A "flocked brush" is constituted of a material which has been made by standard flocking techniques. A flocked brush is preferred for application of a composition to hair, eyebrows and/or eyelashes. However, if the cosmetic composition is intended for application to skin or lips (for example, a lip gloss), the cosmetic applicator of the invention need not include a flocked brush.

Exemplary details of the cosmetic applicator will now be described.

Referring now to the drawings, like reference numerals designate identical or corresponding parts throughout the several views. The drawings are not drawn to scale. Accordingly, the following discussion discloses and describes merely exemplary embodiments of the present disclosure. As will be understood by those of ordinary skill in the art, the present disclosure may be embodied in other specific forms without departing from the spirit or essential characteristics thereof. Accordingly, the present disclosure is intended to be illustrative, but not limiting, of the scope of the present invention. The disclosure, including any readily discernible variants of the teachings herein, defines, in part, the scope of the foregoing claim terminology such that no inventive subject matter is dedicated to the public.

FIG. 1 shows an exemplary flocked mascara applicator 100 in which one or more technologies or methodologies can be implemented, such as, for example, having an applicator that provides a mechanism of applying mascara in a seamless manner and/or provides a pleasant sensation when used. In an embodiment, the flocked mascara applicator 100 is a two- to three-piece device including an applicator head 101 having an end portion 101*a* and a deformable container 103 (also referred herein as a tube 103). In an embodiment, the container 103 is provided as a hollow container that carries the cosmetic composition (e.g., mascara or other fluid material) and deforms upon application of force. The tube 103 can be of different shape such as a pipe-shaped, grip shaped, or any other shape that can be held and deformed with fingers or palms.

In one embodiment, the tube 103 is essentially shaped as a cylinder that is pinched (sealed) at one end (distal end) and connected to the applicator head 101 at the other end (proximal end). The tube 103 may be hermetically sealed at the distal end in order to provide a sealed container. Furthermore, the inside walls of the tube 103 may be coated with special coatings in order to inhibit the tube's material from reacting with the contents.

The tube 103 may be attached at its proximal end to the applicator head 101 via any suitable means such as, for example, a locking mechanism such as, for example, a click-lock mechanism during assembly or it may be twisted together with the applicator head 101 via a threading mechanism (not shown). In one embodiment, the tube 103 is a soft-squeezable reservoir that may be made of any suitable deformable material such as, for example, plastic, paperboard, aluminum or the like. The volume of the tube can be of any size, but preferably of a size which contains 1.5 to 20 ml, 1.5 to 17 ml, and preferably 1.5 to 15 ml of cosmetic composition. However, it must be appreciated that smaller-sized tubes can be manufactured, for example, for a travel-size applicator. Furthermore, the applicator 100 can be manufactured as a one-piece unit where the tube and the applicator head forms a unitary construction. Such applicators, upon use, can be discarded, if desired. A refill (with cosmetic composition) provision for the one-piece applicator can also be provided.

The applicator head 101 includes a proximal end that is attached to the tube 101 and a distal end that includes a flocked brush 105. The applicator head 101 may be made of a soft or hard material. In one embodiment, the applicator head is curved in shape, wherein the degree of curvature is such that the mascara tube 100 provisions for easy application of the mascara to curved surfaces such as a user's eyebrows and/or eyelashes. The degree of curvature may be predetermined in a manner that is deemed appropriate to one of ordinary skill in the art to achieve desired application to the desired keratinous material. Additionally, in an embodiment, the flocked brush 105 may be oriented in a manner such that a longitudinal axis or the flocked brush is substantially parallel to the longitudinal axis of the tube 103.

Figures 2A, 2B:
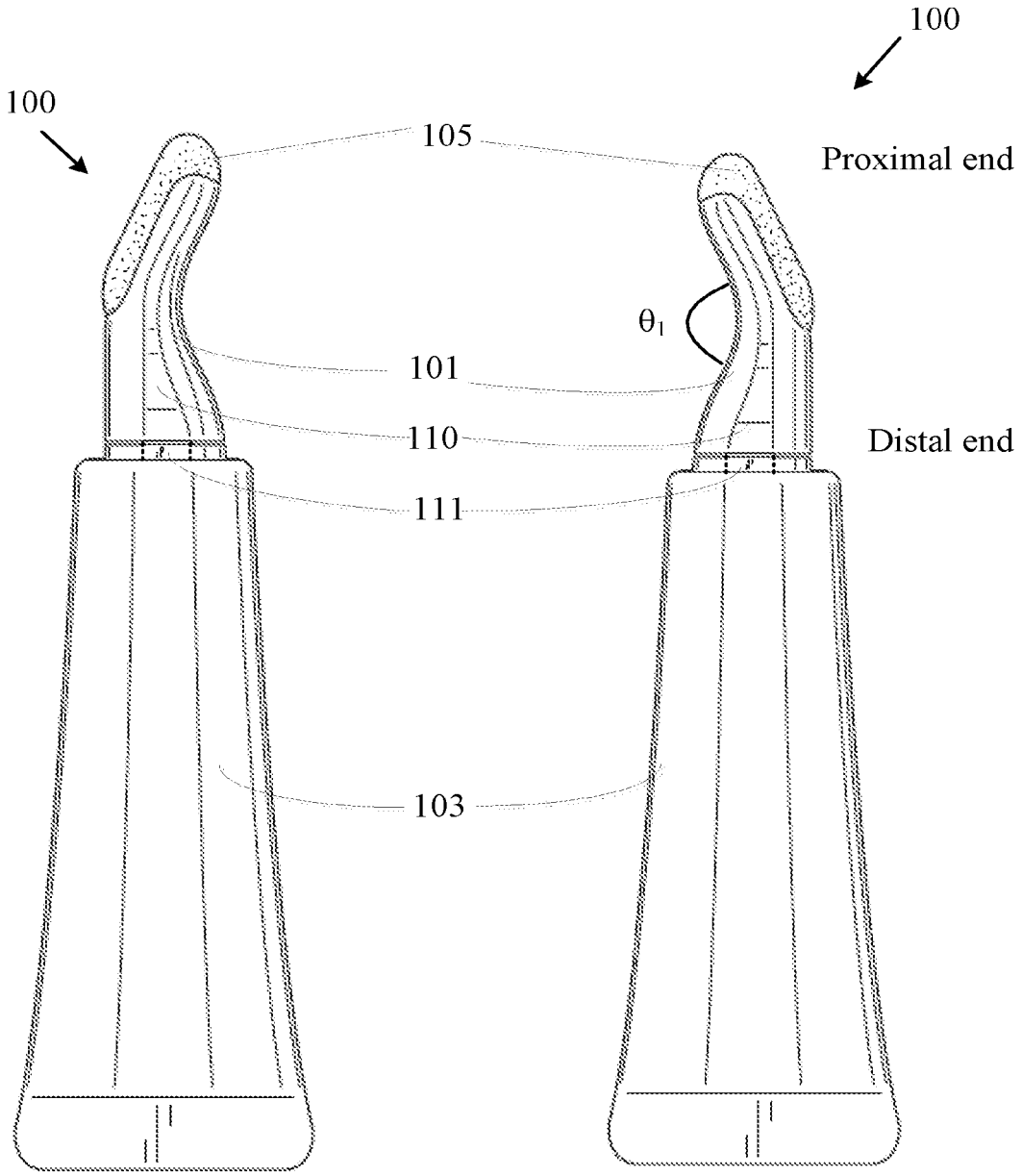
FIGS. 2A and 2B depict exemplary left and right side prospective views of the mascara tube of FIG. 1 according to an exemplary embodiment of the present disclosure.

As shown in FIGS. 2A and 2B that depict left and right side perspective views of the flocked applicator 100, respectively, the flocked material (brush) 105 is extended over an end portion 101*a* of the applicator head 101, and around the circumference. For example, the flocked brush 105 can be spread partially or fully along the circumference of the applicator head 101. In one embodiment, the flocked brush 105 preferably covers one-third to one-half of the circumference of the applicator head 101. In doing so, the mascara applicator provisions for the application of the mascara at the corners and bottom of eyelashes in an easy manner. The extension of the flocked brush 105 over the end portion 101*a* of the applicator head 101 is further shown in FIGS. 2C and 2D which depict the front side and back side prospective views of the mascara tube of FIG. 1. Moreover, FIGS. 2E and 2F depict exemplary top and bottom views of the mascara tube of FIG. 1, respectively.

Referring to FIGS. 2A and 2B, the applicator head 101 has a curvature defined by an angle $\theta_1$. Due to the curvature, the flocked brush 105 is inclined with respect to a longitudinal axis of the applicator 100. Increasing or decreasing the angle $\theta_1$ can affect the amount of mascara transported to the flocked brush 105. For example, an acute angle $\theta_1$ (e.g., less than 90°) may need higher force on the tube 103 compared to an obtuse angle $\theta_1$ (e.g., greater than 100°) to transport a particular amount of mascara to the flocked brush 105.

Providing an optimum curvature should be maintained to allow easy transportation and application of cosmetic composition such as mascara. Preferably, the angle $\theta_1$ is between about 90 and about 260, preferably between about 110 and about 200, and preferably about 120 and about 180. The angle $\theta_1$ may also interact with properties of the cosmetic composition such as, for example, viscosity, consistency, and critical strain. For example, for a lower viscosity and/or lower consistency mascara, a smaller angle may provide sufficient resistance to transport an optimum amount of mascara to the flocked brush 105 than a higher viscosity and/or consistency.

The flocked mascara applicator 100 provisions for easy transport of the mascara from the tube to the flocked brush 105 and utilizes the curvature of the applicator head 101 for easy application of the mascara. Furthermore, it may be possible to provide for refills of the tube and/or switching the applicator head.

Figure 2C:
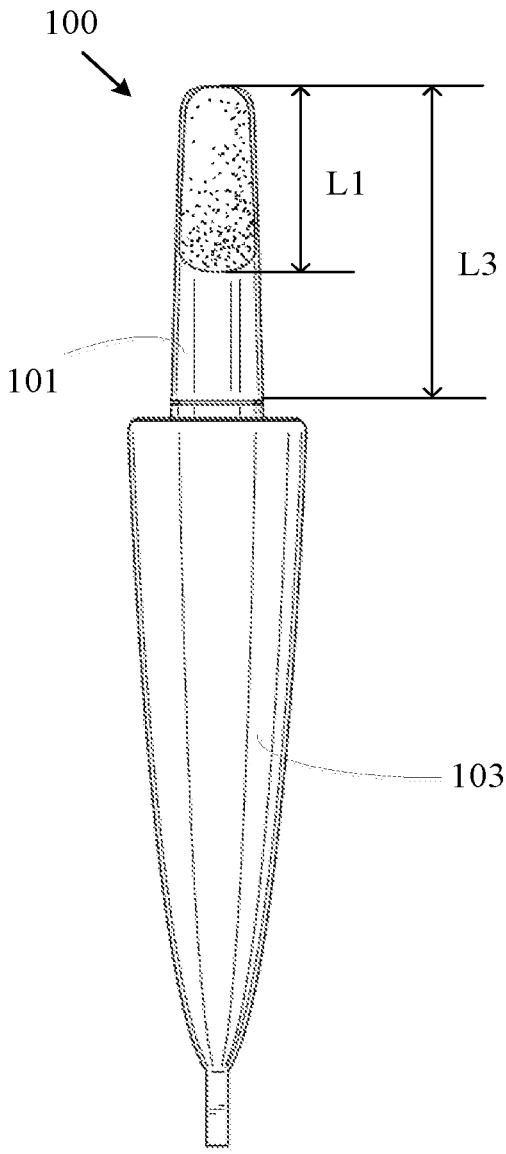
FIGS. 2C and 2D depict exemplary front side and back side prospective views of the mascara tube of FIG. 1 according to an exemplary embodiment of the present disclosure.
Figure 2D:
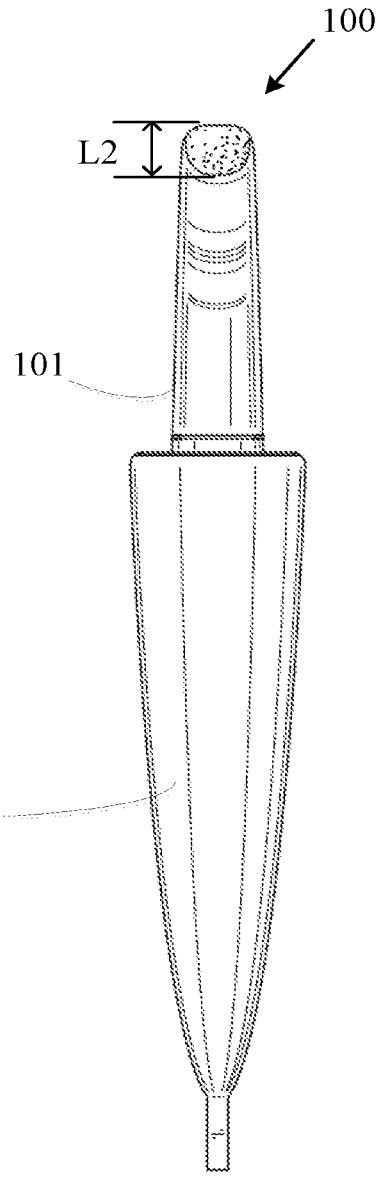
Figure 2E:
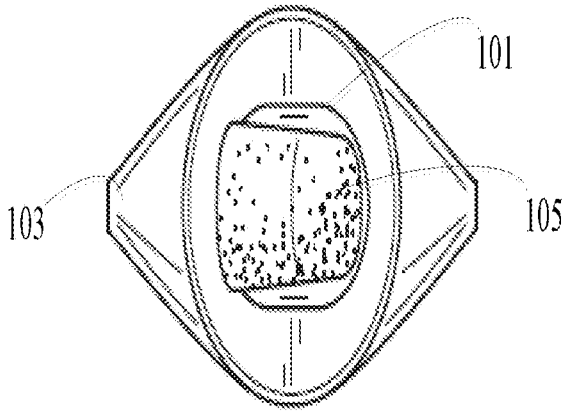
FIGS. 2E and 2F depict exemplary top and bottom views of the mascara tube of FIG. 1 respectively according to an exemplary embodiment of the present disclosure.
Figure 2F:
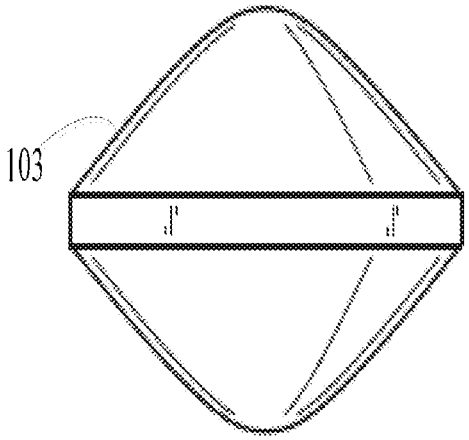

Referring to FIGS. 2C and 2D, the applicator head 101 can be of length L3, and the flocked brush 105 can have a length L1 on the front side and a length L2 on the back side of the applicator head 101. The length of the flocked brush 105 can also affect an optimum amount of mascara discharged on the flocked brush 105. For example, if the length L1 of the flocked brush 105 is long, more mascara may be discharged to realize a uniform wetting of the flocked brush 105.

Referring back to FIGS. 2A and 2B, the applicator head 101 has an interior applicator channel 110 conforming to the shape of the applicator head 101. The interior applicator channel 101 can extend from an opening of the tube 103 to the end portion 101*a* of the applicator head 101. The interior applicator channel 110 receives mascara from the tube 103 via hole(s) (refer to FIG. 8) and transports the mascara to the flocked brush 105. The interior applicator channel 101 can have a diameter preferably ranging from 0.5 mm to 5 mm, preferably 0.75 mm to 4.5 mm, and preferably from 1 mm to 3 mm. The channel 101 can have a uniform diameter or can have a varying diameter of any type, for example a diameter decreasing or increasing towards the end portion 101*a* of the applicator head 101 resulting in a tapered shape. Such tapering is particularly preferred in embodiments in which the applicator head has a conical shape. The size of the hole is such that there is little or no leakage of mascara between the tube hole(s) and the interior applicator channel 110.

The flocked brush 105 can be made of any suitable material used for flocking materials such as, for example, polyamides, polyesters, rayons, cottons, celluloses, polyacryles, carbone fibers, aramids, etc. Suitable materials include those made and sold under the Hytrel® name. Preferably, the flocked brush 105 is made of materials having (1) 1.5 to 90 dtex, preferably 10 to 80 dtex, and preferably 15-70 dtex, including all ranges and subranges therebetween, (2) 0.5 to 3 mm in length, preferably 0.6 to 2.9 mm in length, and preferably 0.7 to 2.5 mm in length, including all ranges and subranges therebetween, and/or (3) 0.03 to 0.09 mm in diameter. The flocked brush 105 may optionally include polymeric micro-bristles that may be adhered to the applicator head 101 by injection molding techniques, electrostatic techniques and the like. In use, the flocked applicator 100 can transport the mascara from the tube 103 to the flocked brush 105 upon squeezing of the tube 103 (deformable container) or by employing a depressible elements such as a movable piston mechanism within the tube 103 to push the mascara onto the flocked brush 105. The cosmetic composition deposited on the flocked brush 105 may then be applied to the hair, eyebrows and/or eyelashes of the user.

Figure 3:
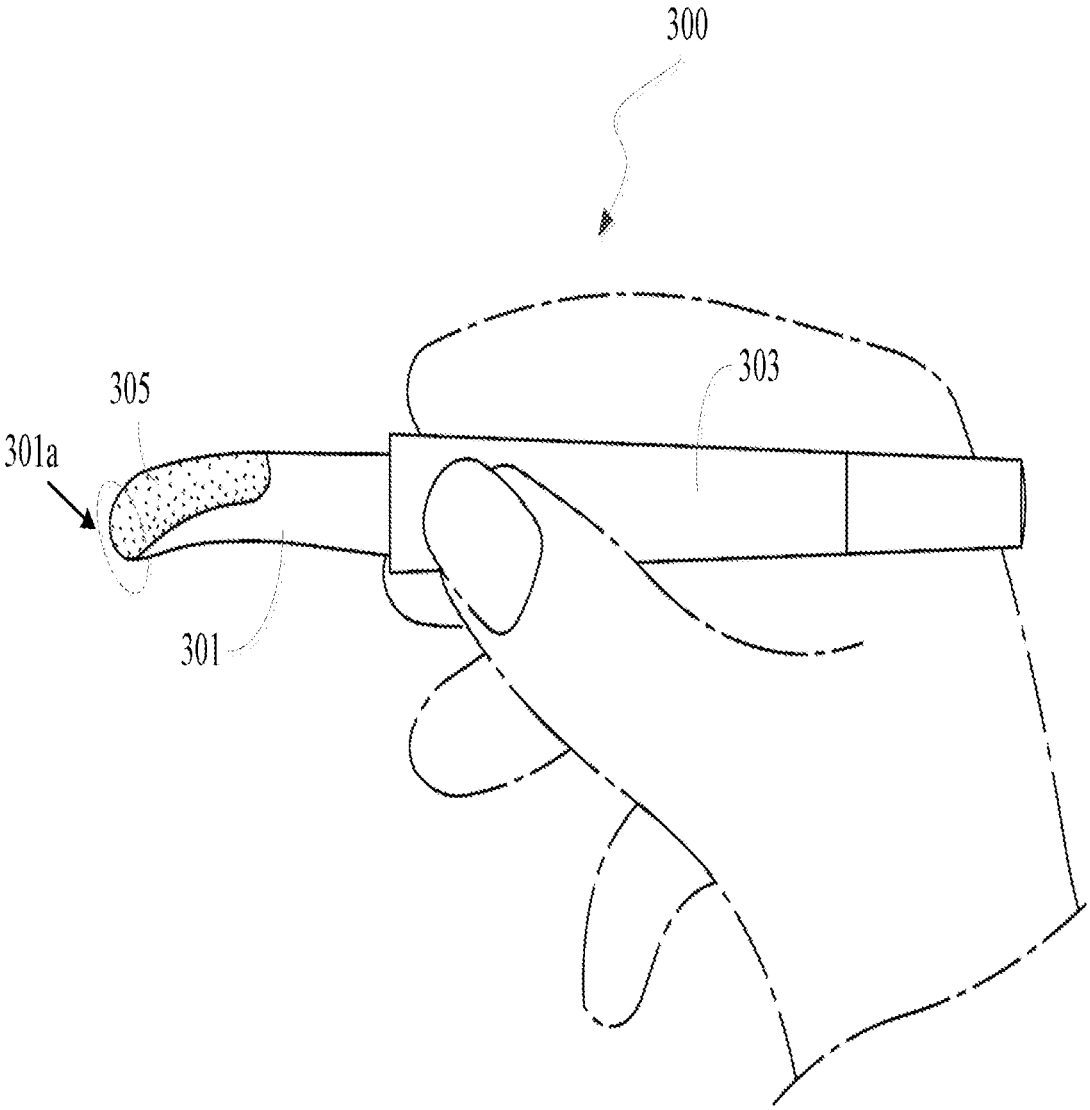
FIG. 3 depicts according to an embodiment, an exemplary mascara pen including a flocked applicator according to an exemplary embodiment of the present disclosure.

Referring to FIG. 3, an example of a flocked mascara applicator 300 which is a three-piece device including an applicator head 301 having an end portion 301*a* and a pen 303 that has a pen-shaped structure is depicted. The body of the pen 303 is a hollow cylindrical container (deformable or non-deformable) that carries the cosmetic material (mascara). In one embodiment, the pen is air-sealed at one end (distal end) and connected to the applicator head 301 at the other end (proximal end). Additionally, the inside walls of the pen may be coated with special coatings in order to prevent the tube's material from reacting with the contents.

The pen 303 may be attached at its proximal end to the applicator head 301 via any suitable means such as, for example, a locking mechanism such as, for example, a click-lock mechanism during assembly or it may be twisted together with the applicator head 301 via a threading mechanism. The pen 303 may be made of plastic, aluminum or the like. The volume of the pen can be of any size, but preferably of a size which contains 0.75 to 5 ml, 1 to 4.5 ml and preferably 1.5 to 4 ml of cosmetic composition. However, it must be appreciated that smaller sized pens can be manufactured, for example, a travel-size flocked applicator. Furthermore, the applicator 300 can be manufactured as a one-piece unit where the pen and the applicator head form a unitary construction. Such applicators, upon use, can be discarded, if desired. A refill (with cosmetic composition) provision for such a one-piece applicator may further optionally be provided.

The applicator head 301 includes a proximal end that is attached to the tube 101 and a distal end that includes a flocked brush 305. The applicator head 301 may be made of a soft or hard polymer-like material. In one embodiment, the applicator head is curved in shape, wherein the degree of curvature is such that the mascara applicator 300 provisions for easy application of the mascara to curved surfaces such as a user's eyelashes as discussed above.

The flocked brush 305 is preferably made of the materials discussed above. The flocked brush 305 may optionally include polymeric micro-bristles that may be adhered to the applicator head 301 by injection molding techniques, electrostatic techniques and the like. In use, the flocked applicator 300 can transport the mascara from the body of the pen 303 to the flocked brush 305 by using a dispensing mechanism based on clicking or using a push pen with a movable piston-like mechanism. It should be appreciated that any structure that moves the mascara from the pen to applicator 301 can be used. Additionally, the pen 303 may transfer the cosmetic composition to the brush 305 by shaking the pen 303 in a back and forth manner. The cosmetic composition deposited on the flocked brush 105 may then be applied to the hair, eyebrows and/or eyelashes of the user.

Figures 4A, 4B:
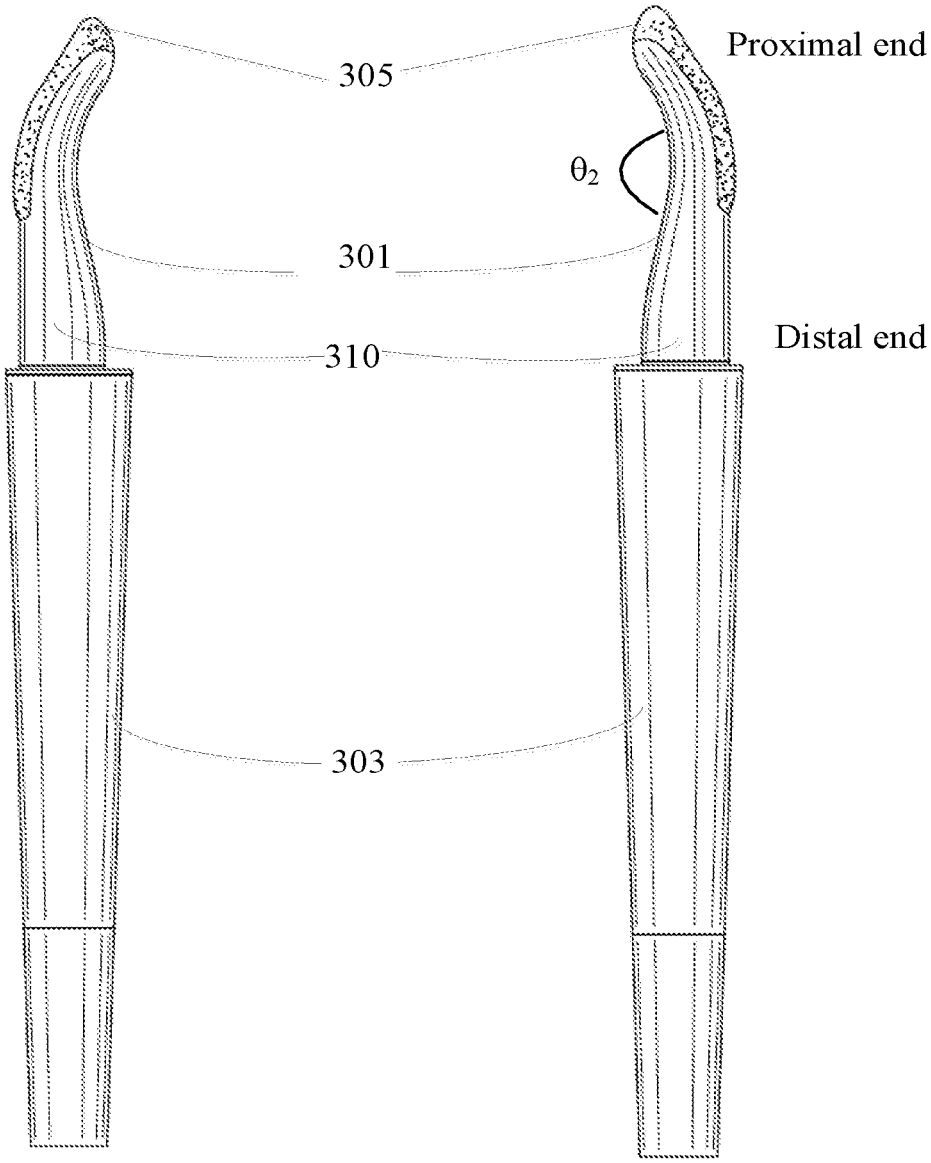
FIGS. 4A and 4B depict exemplary left and right side prospective views of the mascara pen of FIG. 3 according to an exemplary embodiment of the present disclosure.

As shown in FIGS. 4A and 4B that depict left and right side perspective views of the flocked applicator 300, respectively, the flocked material (brush) 305 is extended over the end portion 301*a* of the applicator head 301 or around the circumference. For example, the flocked brush 305 can be spread partially or fully along the circumference of the applicator head 301. In one embodiment, the flocked brush 305 can cover one-third to one-half of the circumference of the applicator head 301. Such spread of the flocked brush 305 enables easy application of the mascara at the corners and bottom of eyelashes easier. This is further evident in FIGS. 4C and 4D that depict exemplary front side and back side prospective views of the mascara pen of FIG. 3.

Accordingly, the flocked mascara applicator 300 provisions for easy transport of the mascara from the pen 303 to the flocked brush and utilizes the curvature of the applicator head for easy application of the mascara. Moreover, FIGS. 4E and 4F depict exemplary top and bottom views of the mascara pen of FIG. 3 respectively. Furthermore, since the flocked applicator is a three-piece device, a provision of purchasing refills of the tube and/or switching the applicator head can be further provided.

Referring to FIGS. 4A and 4B, in one embodiment the applicator head 301 can have a curvature defined by an angle $\theta_2$. The angle $\theta_2$ can be different from the angle $\theta_1$, as the dispensing mechanism for the applicator 300 having the pen 303 can be different, for example, squeezing for tube 103 and shaking or pushing by a movable piston for the pen 303. The curvature of the applicator head 301 (or 101) can be a function of the type of reservoir (e.g., tube 103 or pen 303) and dispensing mechanism. Providing an optimum curvature should be maintained to allow easy transportation and application of mascara. Preferably, the angle $\theta_2$ is between about 90 and about 260, preferably between about 110 and 200, and preferably between about 120 and 180. The angle $\theta_2$ may also interact with properties of the cosmetic composition such as, for example, viscosity, consistency, and critical strain. For example, for a lower viscosity and/or lower consistency mascara, a smaller angle may provide sufficient resistance to transport an optimum amount of mascara to the flocked brush 305 than a higher viscosity and/or consistency.

Figures 4C, 4D:
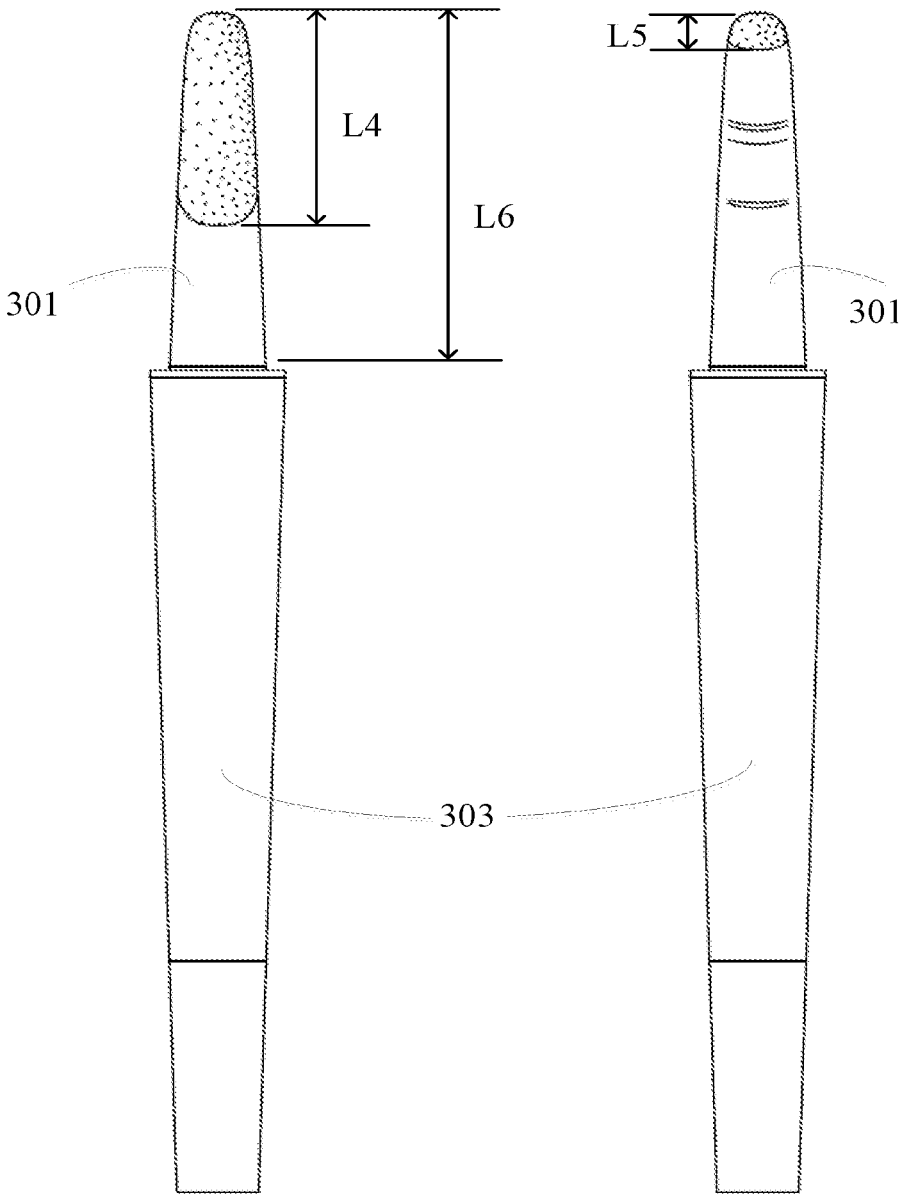
FIGS. 4C and 4D depict exemplary front side and back side prospective views of the mascara pen of FIG. 3 according to an exemplary embodiment of the present disclosure.

Referring to FIGS. 4C and 4D, the applicator head 301 can be of length L6, and the flocked brush 305 can have a length L4 on the front side and a length L5 on the back side of the applicator head 301. The length of the flocked brush 305 can affect an optimum amount of mascara discharged on the flocked brush 305. For example, if the length L4 of the flocked brush 305 is long, more mascara should be discharged to wet the flocked brush 305.

It must be appreciated that the shape of the cosmetic applicators 100 and 300 as shown in FIG. 1 and FIG. 3, respectively, can provide for ease of application and positioning of the flocked brush directly in contact with hair, eyelashes and/or eyebrows. For instance, referring to FIG. 1, crimping along the axis of the tube 103, provisions for easier grip of the tube. Such an orientation of the cosmetic applicator positions the flocked brush directly towards the eyelashes, thereby enhancing the ease of cosmetic application, without the need to twist and/or roll the applicator for applying the mascara.

Figure 5A:
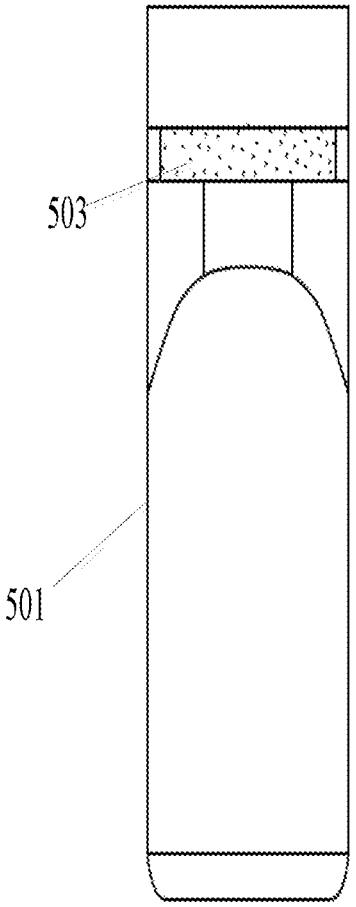
FIGS. 5A and 5B illustrate an exemplary dual function cap according to an exemplary embodiment of the present disclosure.
Figure 5B:
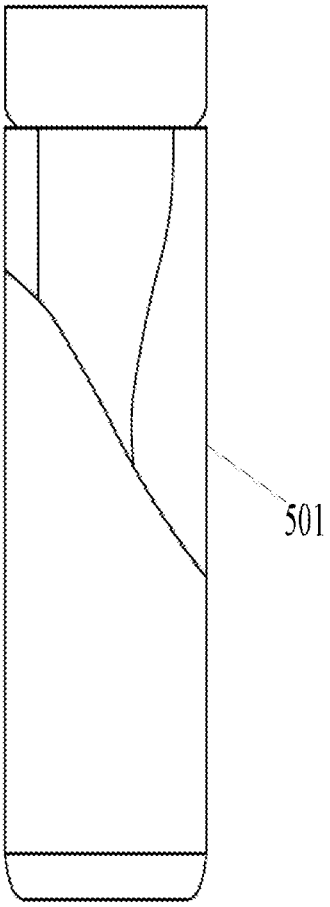

Referring to FIGS. 5A and 5B, exemplary dual function caps are illustrated. As shown in FIG. 5A, the dual function cap includes a cap 501 and a seal 503 that are enclosed in a casing (container) 502. The cap 501 along with the seal 503 prevents the mascara from drying on the applicator head. In one embodiment, the cap 501 may be a mold that has the shape of the applicator head, and can be fitted snugly to cover the applicator head. For instance, the applicator head may be snapped onto the cap or attached via threading and a twist mechanism. The cap 501 can also hold excess bulk composition preventing the applicator from drying out. The cap 501 can also serve the role of holding product vertically in place and can have any shape which allows it to do so. The seal 503 can be made of a hard or soft pliable material and is used to further prevent drying of the mascara. The cap and seal combination may be included in the casing to provide an air tight mechanism in which the applicator head can be maintained. Additionally, the cap can include a holding mechanism such as a snap-on clip, carabiner clip, or the like, which enables a user of the cosmetic applicator to affix the applicator to a bag, pockets of a trouser, and the like, thereby making the cosmetic applicator portable.

The applicator head 101 (or 301) discharges the cosmetic composition such as mascara on to the flocked brush 105 (or 305) via a plurality of holes. According to preferred embodiments of the present invention, the number of holes in the plurality of holes preferably ranges from 2 to 10, preferably from 3 to 9, and preferably from 4 to 8. However, the present disclosure is not limited to specific number of holes. The applicator head 101 can include any number of holes. The plurality of holes can be in any orientation or pattern such as, for example, tabular (e.g., rows and columns of holes), circular, square, triangular, or other appropriate geometrical forms. Preferably, the plurality of holes is in an in-line orientation or a zig-zag orientation. Also, the holes themselves can be of any geometry such as, for example, circular, square, amorphous, rectangular, oval, etc. Preferably, the holes are of all the same geometry, and preferably the holes are all circular. The plurality of holes can be positioned anywhere along the length of the applicator head 101 (or 301) covered with the flocked brush 105 (or 305). The plurality of holes are in an orientation having a length which is at least about 40% of the length of the applicator head, preferably at least about 50% of the length of the applicator head, and at least about 60% of the length of the applicator head. In one embodiment, a majority of the plurality of holes can be concentrated at the top of the applicator head.

Preferably, when circular, the holes have a diameter smaller than 2 mm, preferably smaller than 1.7 mm, preferably smaller than 1.5 mm while preferably being larger than 0.3 mm, preferably larger than 0.5 mm, preferably larger than 0.6 mm and preferably larger than 0.7 mm, including all ranges and subranges therebetween such as, for example, 0.6 mm to 2.0 mm, 0.65 mm to 1.7 mm, and 0.68 mm to 1.6 mm. Of course, if the holes are of different geometry, the size of the holes would correspond to the size of the circular holes identified above (for example, area of non-circular holes would correspond to the area per the formula area=$\pi r^2$ for the diameters identified above).

Figure 8:
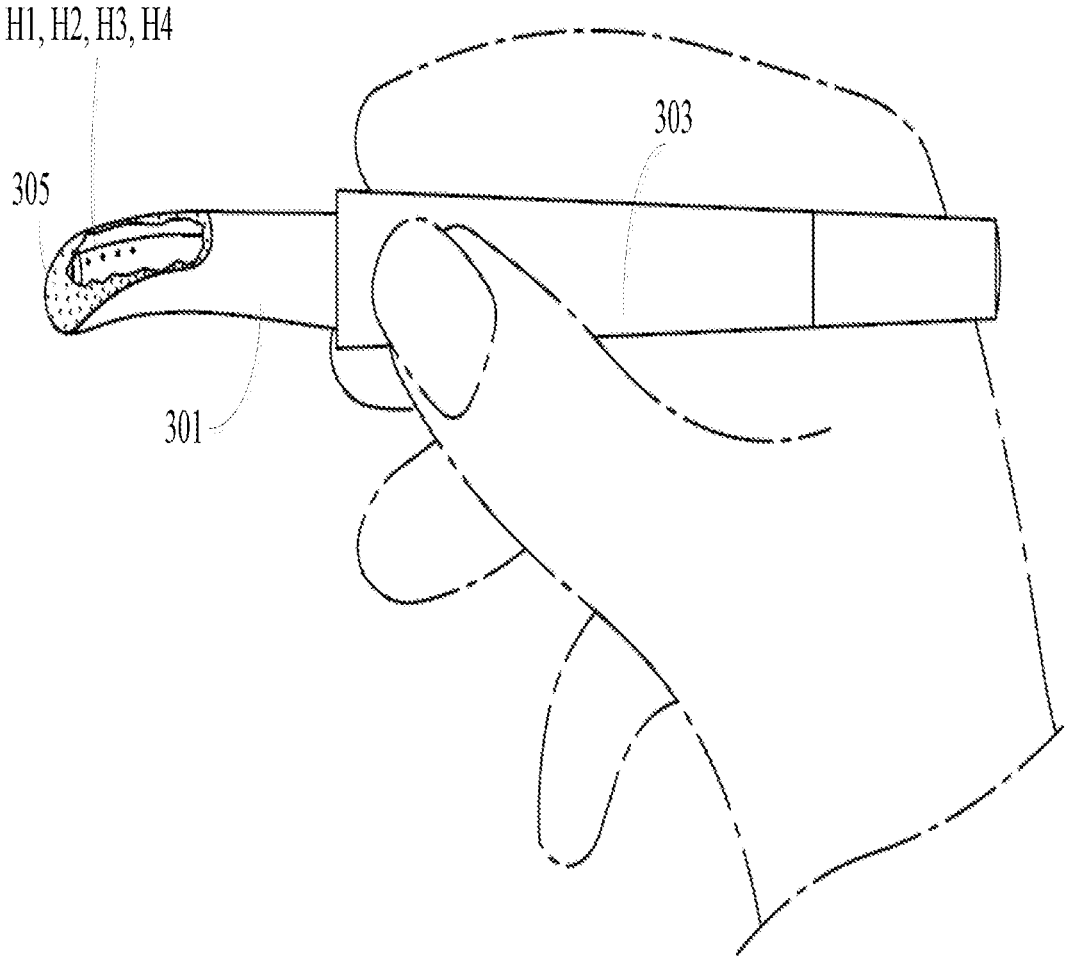
FIG. 8 illustrates an applicator with plurality of holes according to an exemplary embodiment of the present disclosure.

The plurality of holes controls an amount of mascara discharge on the flocked brush 105 (or 305). FIG. 8 illustrates a location of the plurality of holes with respect to the applicator head 101. The plurality of holes (e.g., H1, H2, H3, H4) is located on applicator head 301 (or 101) under the flocked brush 305 (or 105). The mascara discharged from the plurality of holes is received by the flocked brush 305 (or 105).

The amount of cosmetic composition such as mascara discharged can be a function of, among other things, a diameter of the plurality of holes, an orientation of the plurality of holes, the number of holes, cosmetic composition (mascara) properties including viscosity, consistency, critical strain, force applied to the tube 103 (or 303), and flock material. An optimum amount of mascara should be discharged to provide deposit of product on the flocked brush 105 (or 305), so that the mascara or cosmetic composition can be applied to a surface such as user's hair, eyelashes or eyebrows.

Figure 7A:
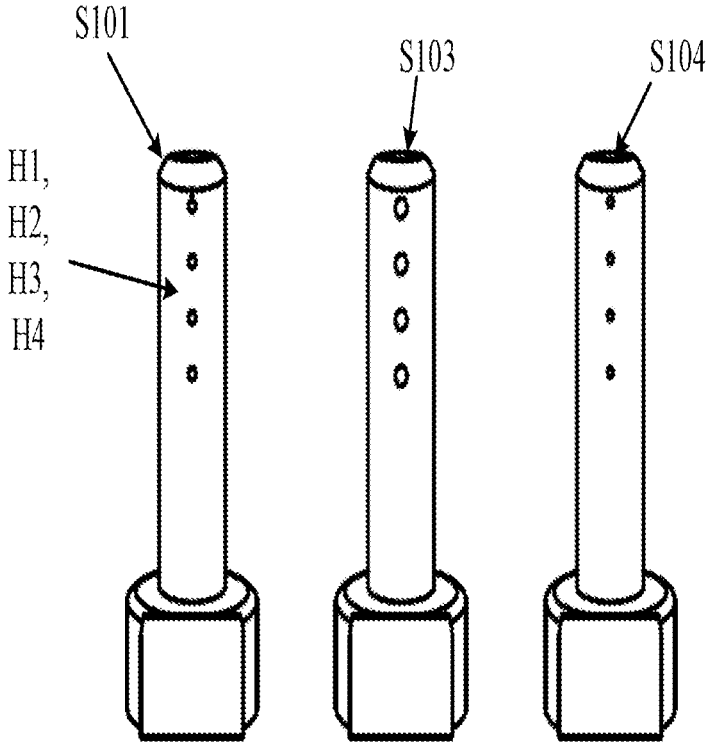
FIGS. 7A-7D illustrate exemplary applicator types according to an exemplary embodiment of the present disclosure.

FIG. 7A illustrates, in a non-limiting manner, three variations of an applicator S100 that includes applicators with either a head S101, a head S103, or a head S104. The heads S101, S103, and S104 are unflocked for illustration purposes. The heads S101, S103, and S104 each have four holes oriented in-line. Further, each of the four holes of the head S101 (or S103 or S104) can have different diameters.

Exemplary dimension of holes of the heads S101, S103, and S104 are illustrated in table of FIG. 6.

Figure 7B:
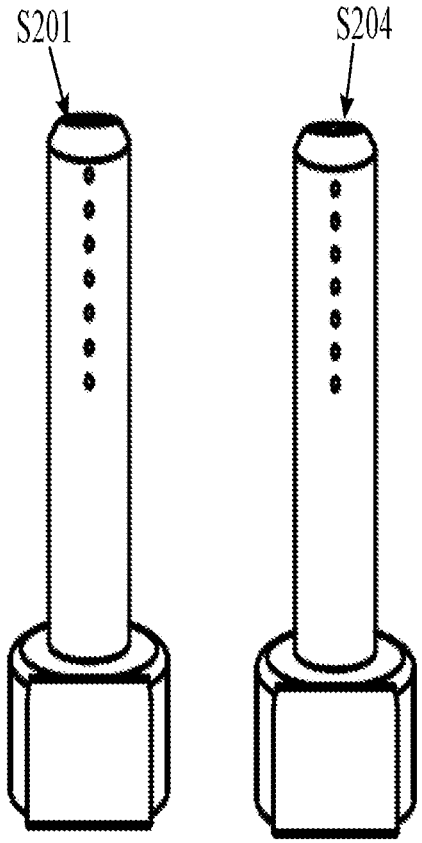

FIG. 7B illustrates two variations of applicator S200 that includes applicators with either a head S201, or a head S204. The heads S201 and S204 are unflocked for illustration purposes. The heads S201 and S204 each have seven holes oriented in-line. Further, each of the four holes of the head S101 (or 3103 or S104) can have different diameters. Exemplary dimension of holes of each head S201, and S204 are illustrated in table of FIG. 6.

Figure 7C:
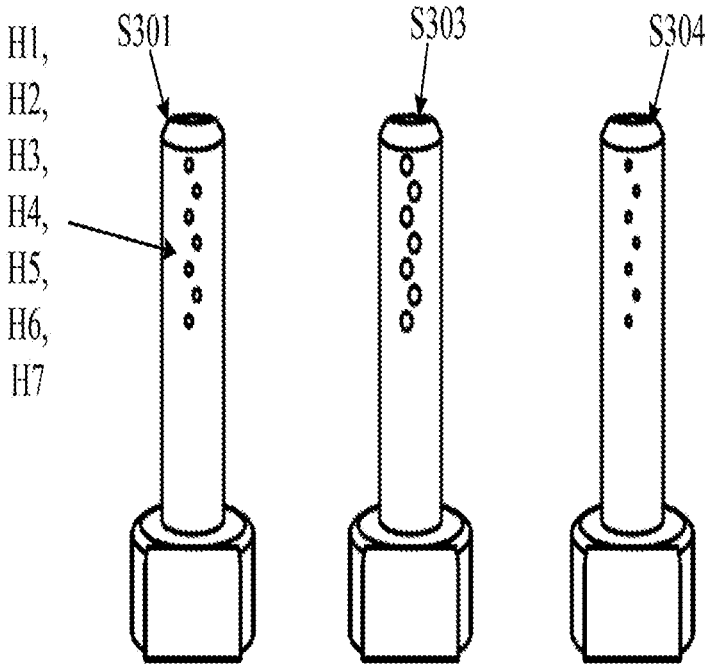

FIG. 7C illustrates three variations of S300 that includes applicators with either a head S301, a head S303, and third head S304. The heads S301, S303, and S304 are unflocked for illustration purposes. The heads 3301, 3303, and S304 each have seven holes oriented in a zig-zag manner. Further, each of the four holes of the head S101 (or S103 or 3104) can have different diameters. Exemplary dimension of holes of each head S301, S303, and S304 are illustrated in table of FIG. 6.

Figure 7D:
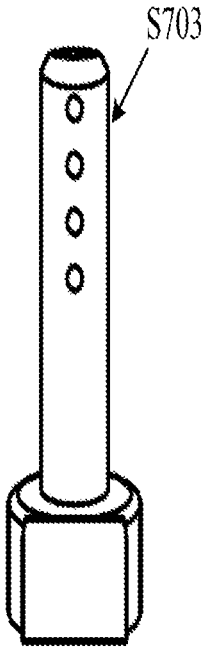

FIG. 7D illustrates applicator S700 that includes a head S703. The head S703 is unflocked for illustration purposes. The head S703 has four holes oriented in-line. Further, each of the four holes of the head S101 (or S103 or 3104) can have different diameters. Exemplary dimension of holes of head S703 is illustrated in table of FIG. 6.

Figure 9:
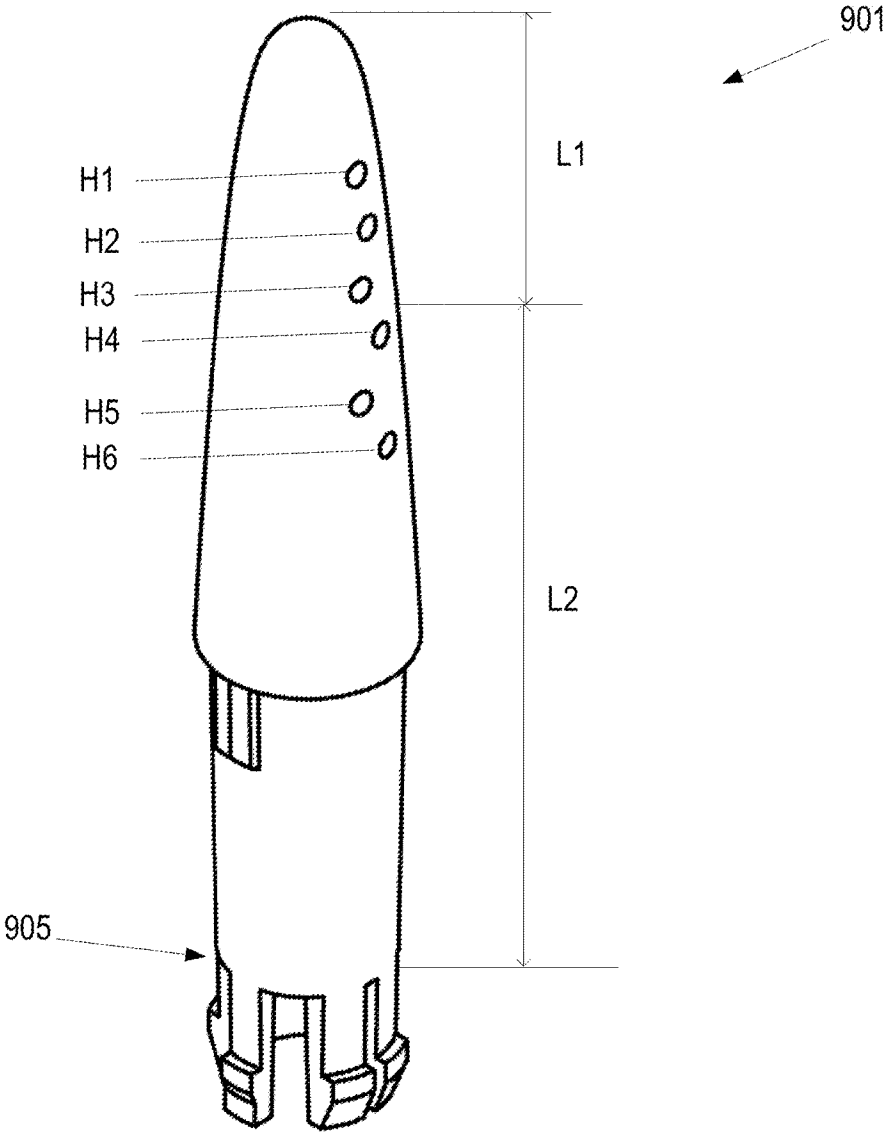
FIG. 9 is an isometric view of an applicator head with plurality of holes according to an exemplary embodiment of the present disclosure.

FIG. 9 is an isometric view of an applicator head 901 with plurality of holes according to an exemplary embodiment of the present disclosure. The applicator head 901 includes, for example, six holes H1-H6 arranged in the zig-zag orientation. However, present disclosure is not limited to six holes and zig-zag orientation. Alternatively or in addition, more than (or less than) six holes may be included. Furthermore, the orientation can be in-line, spiral formation along the circumference of the applicator head, grid-like formation with two or more holes adjacent to each other, triangular formation with number of holes increasing from the tip to the base of the triangle, or other appropriate hole orientation.

In FIG. 9, showing an example of six holes, the holes H1-H6 can be concentrated close to the proximal end of the applicator head 901, according to the present example, for easy application of cosmetic material to eyelashes at the end of an eye (e.g., close to the nose or close to the ear). In one example, the holes H1-H6 may or may not be evenly distributed and can be concentrated in approximately an upper half of the applicator head 901. For example, a majority of the holes can be concentrated in approximately the top 25% of the length of the applicator head 901, or in an alternative example, in approximately the top 10-15% of the length of the applicator head 901.

Furthermore, in one example, the applicator 901 can include plurality of holes only in an upper half of the applicator and not the entire length of the applicator head 901. Also, in another variation the number of holes concentrated in an upper half of the applicator head 901 can vary. For example, 3 holes may be included in top 25% of the length (e.g., length L1), while remaining 3 holes may be spread over the remaining 75% of the length (e.g., length L2) of the applicator head 901. In another example, the applicator head 901 can have more than six holes, six holes may be concentrated in top 10-15% of the length of the applicator head 901 in a grid-like pattern with three columns and two rows of the holes, and additional four holes may be spread in-line below the grid-like pattern.

The distal end of the applicator head 901 includes snap legs 905 that allow the applicator head 901 to be removably attached to a tube, adapted to fit the snap legs 905, of the cosmetic applicator. Thus, the applicator head 901 can be snap fitted to the tube of a cosmetic applicator. As such, the applicator head 901 can be removable attached to any tube of different cosmetic applicators that is adapted to accommodate the snap legs 905.

Figure 10:
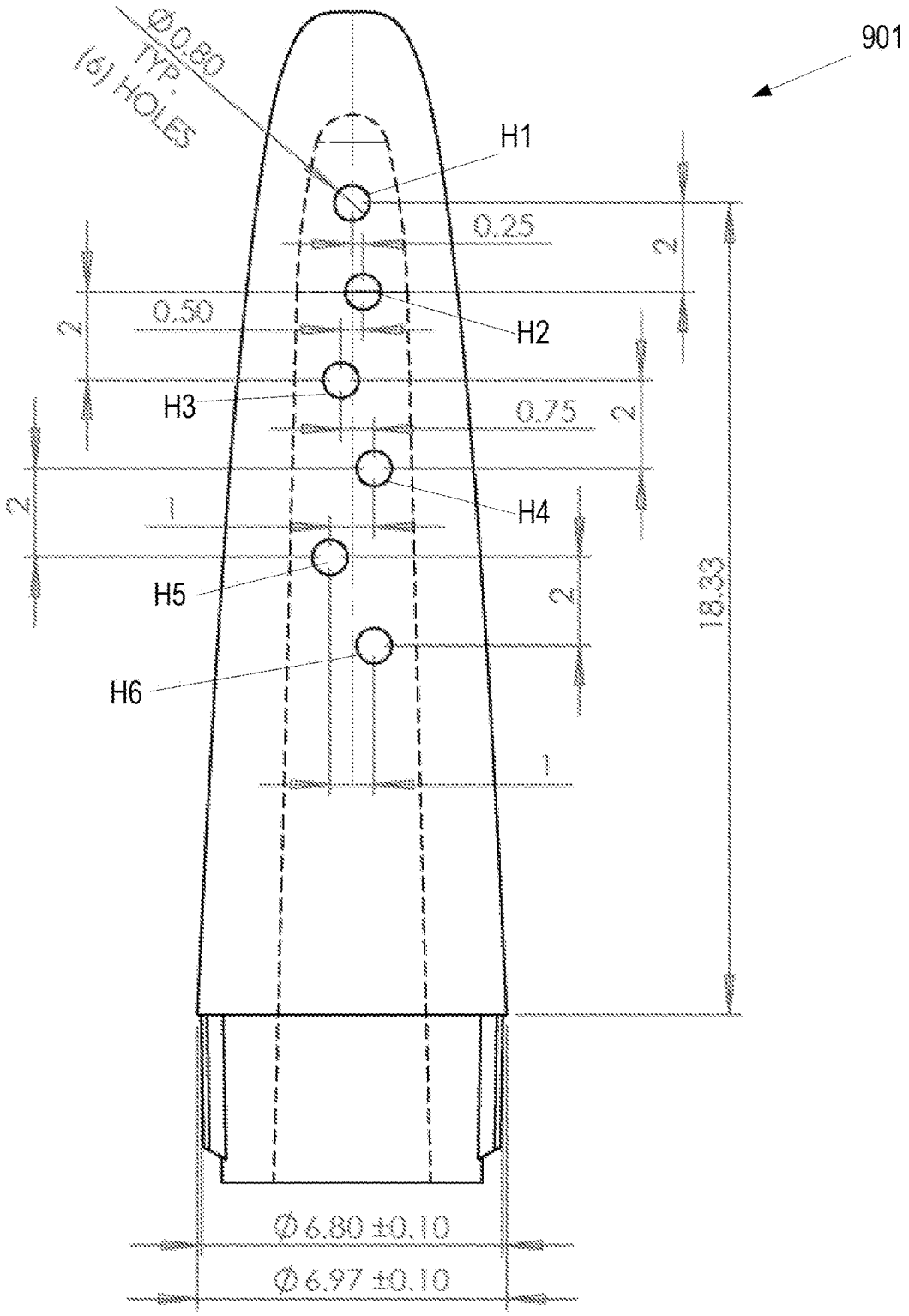
FIG. 10 illustrates example dimensions of the applicator head of FIG. 9 according to an exemplary embodiment of the present disclosure.

FIG. 10 illustrates exemplary dimensions of the holes H1-H6 and their distribution along the applicator head 901. For example, all the holes can be 0.8 mm in diameter. The holes (e.g., holes H1, H2, and H3) close to a tip (or the proximal end) of the applicator head 901 are closely packed with an offset distance (measured along a horizontal direction) between the hole H1 and H2 of proximately 0.25 mm and the offset distance between the hole H2 and H3 of proximately 0.5 mm. The holes such as H4, H5, and H6 that are further away from the tip of the applicator head 901 have a wider spread compared to the holes H1-H3. For example, the offset distance between the holes H4 and H5 is proximately 0.75 mm, and that between the holes H5 and H6 is proximately 1 mm.

According to one example, the offset distance between the holes can be proportional to the length of the applicator head 901 and can progressively increase along the length of the applicator head 901. While, a vertical distance between the holes H1-H6 can remain constant or may vary as well. For example, the distance between the holes H1-H6 can constant of proximately 2 mm. In another example, the vertical distance between the holes can be 1 mm for first three holes (e.g., H1-H3) and 2 mm for next three holes (e.g., H4-H6). In yet another example, eight holes can be arranged in grid-like formation with two columns and four rows. Furthermore, the distance between the first and second row of holes can be 1 mm, the distance between the second and third row of holes can be 1.5 mm and the distance between the third and the fourth row of holes can be 3 mm. In yet another example, six hole can be arrange in a triangular formation with one hole at the apex, a first row of two holes below the first hole, and a second row of three holes at the base of the triangle. Furthermore, the distance between the first hole and first row can be 1 mm, and the distance between the first row and the second row can be 2 mm.

Thus, a majority (e.g., more than 50% or 60-75% of holes) of the plurality of holes can be concentrated at the top (50%, or 25% or 10-15% of the length) of the applicator head 901 in different orientations such as in-line, spiral formation along the circumference of the applicator head, grid-like formation with two or more holes adjacent to each other, triangular formation with number of holes increasing from the tip to the base of the triangle, or other appropriate hole orientation. As more holes are concentrated at the tip of the applicator head 901, more mascara will be concentrated towards the tip of the applicator head 901 which in turn allows uniform and easy application of the mascara to the eyelashes at the end of the eye.

Figure 11A:
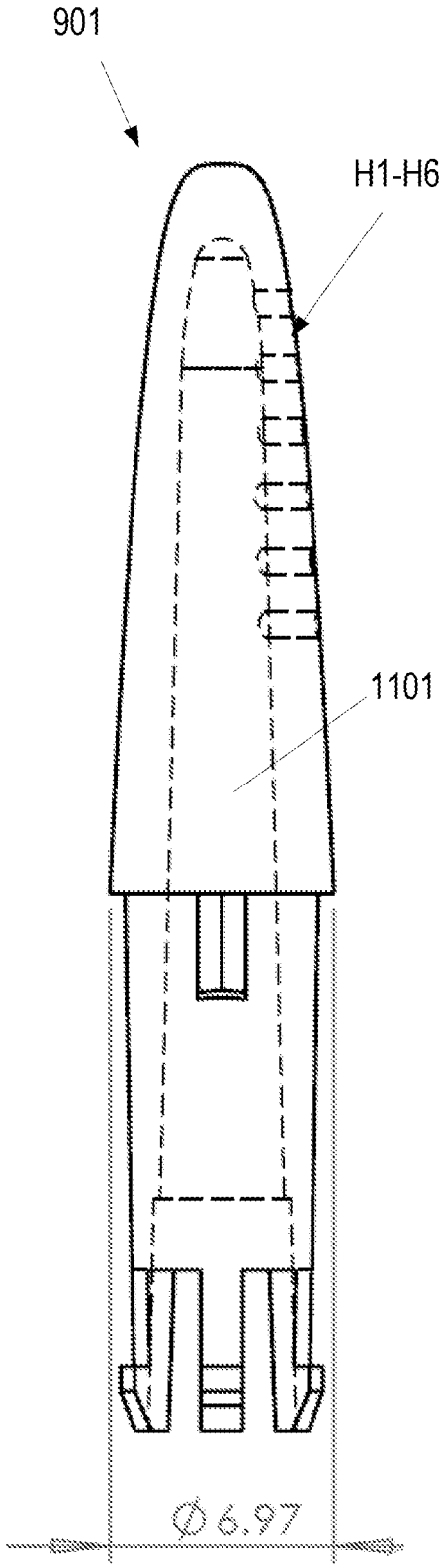
FIGS. 11A and 11B are side views of the applicator head of FIG. 9 according to an exemplary embodiment of the present disclosure.
Figure 11B:
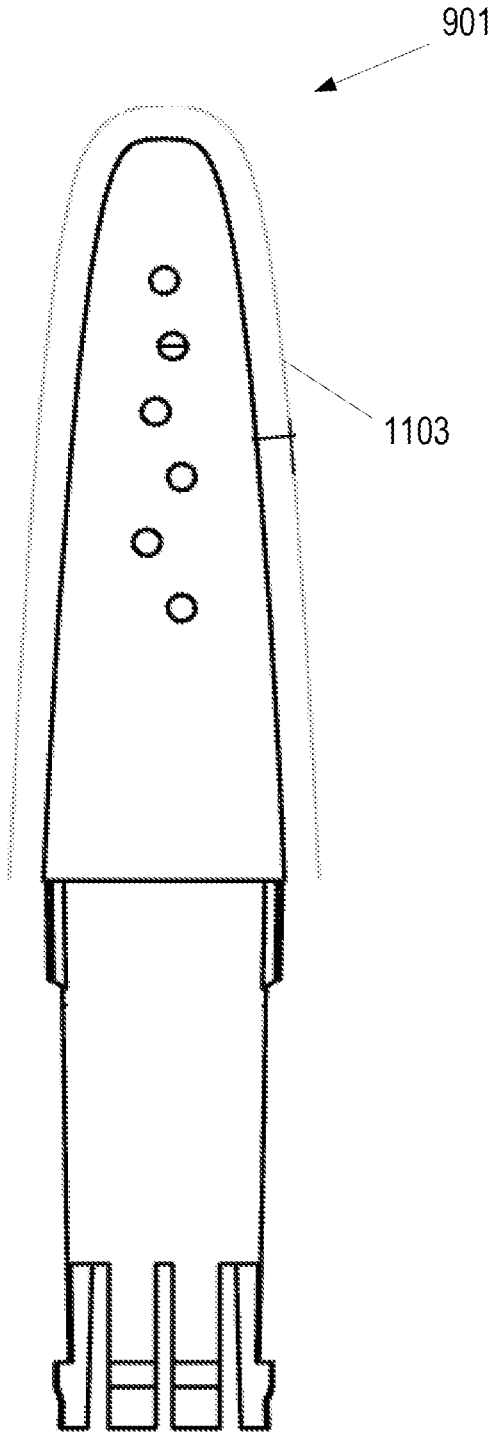

FIGS. 11A and 11B are side views of the applicator head of FIG. 9 according to an exemplary embodiment of the present disclosure. In FIG. 11A, the applicator head 901 includes the holes H1-H6 that connect to an inner channel 1101. Through the inner channel 1101, the mascara can be directed out of the holes H1-H6 on to a flocked brush 1103 (in FIG. 11B). As the hole concentration is higher at the proximal end (close to the tip), more mascara is spread over the flocked brush at close to the tip of the applicator head 901.

Figures 12A, 12B:
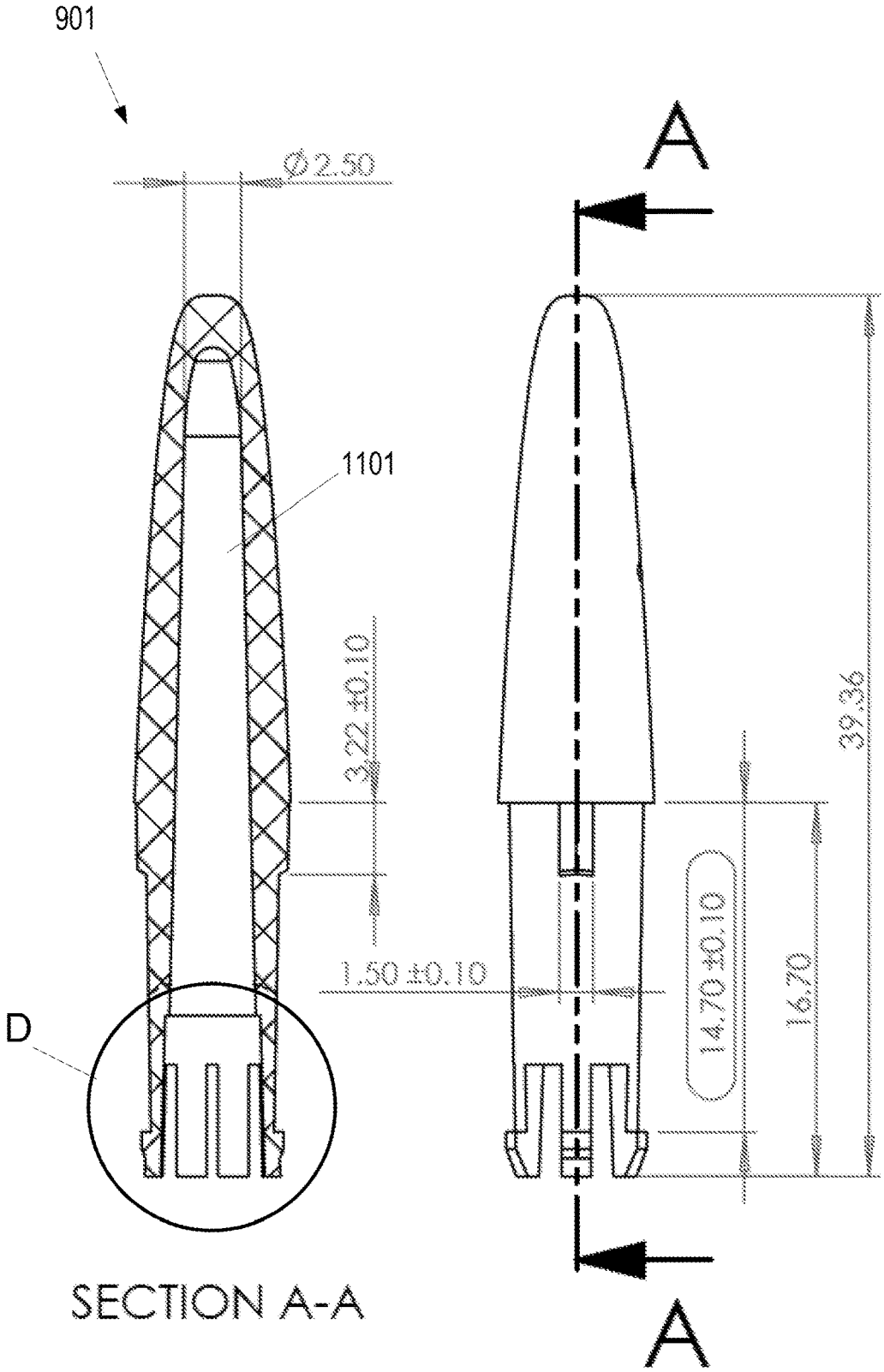
FIG. 12A is side view of the applicator head of FIG. 9 according to an exemplary embodiment of the present disclosure.
FIG. 12B is cross-section view of the applicator head of FIG. 12A according to an exemplary embodiment of the present disclosure.
Figure 12C:
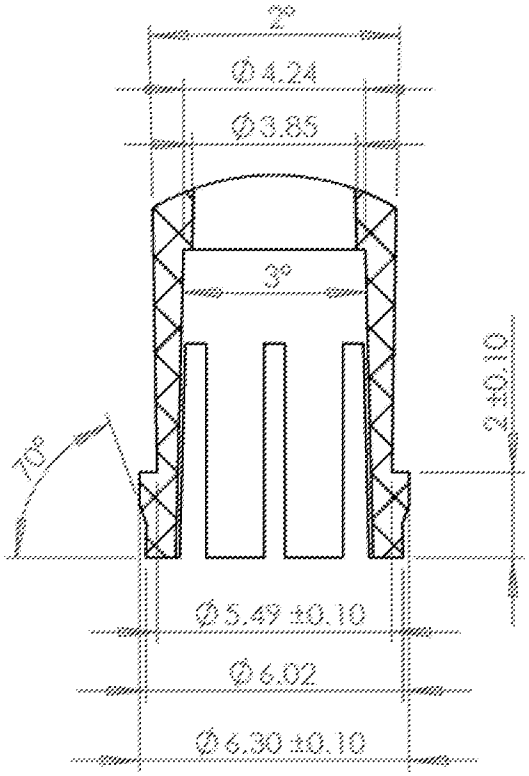
FIG. 12C is cross-section view of a snap leg of the applicator head illustrated in FIG. 12B according to an exemplary embodiment of the present disclosure.

FIG. 12A is side view of the applicator head of FIG. 9 according to an exemplary embodiment of the present disclosure and FIG. 12B shows a cross-section view when the applicator head is cut away at A-A. In FIG. 12B, the applicator 901 includes the inner channel 1101, which has a conical shape. Furthermore, FIG. 12C illustrates a cross-section view of a distal end the applicator head 901 illustrated in FIG. 12B. In FIG. 12C, the dimension of the snap legs are exemplary and does not limit the scope of the present disclosure.

The above disclosure also encompasses the embodiments noted below.

(1) A cosmetic applicator including a deformable container configured to store a cosmetic composition, an applicator head having a linear or non-linear shape with a proximal end and a distal end, and a plurality of holes along or around the circumference of the applicator head, the distal end connected to the container, and a flocked brush extending along the applicator head covering at least a portion of the plurality of holes.

(2) The cosmetic applicator of feature (1), wherein the flocked brush covers the entirety of the plurality of holes.

(3) The cosmetic applicator of feature (1), wherein the flocked brush is made of a material having (a) 1.5 to 90 dtex, (b) 0.5 to 3 mm in length, and (c) 0.03 to 0.09 mm in diameter.

(4) The cosmetic applicator of feature (1), wherein the number of holes in the plurality of holes is from 4 to 8.

(5) The cosmetic applicator of feature (1), wherein the holes in the plurality of holes are not uniform in size.

(6) The cosmetic applicator of feature (1), wherein the holes in the plurality of holes are uniform in size.

(7) The cosmetic applicator of feature (1), wherein the applicator head is curved with an angle between the proximal end and the distal end in the range 90° to 260°.

(8) A cosmetic applicator including a cylindrical container configured to store a cosmetic composition having a depressible element, an applicator head having a linear or non-linear shape with a proximal end and a distal end, and a plurality of holes along or around the circumference of the applicator head, the distal end connected to the container, and a flocked brush extending along the applicator head covering at least a portion of the plurality of holes.

(9) The cosmetic applicator of feature (8), wherein the flocked brush covers the entirety of the plurality of holes.

(10) The cosmetic applicator of feature (8), wherein the flocked brush is made of a material having (a) 1.5 to 90 dtex, (b) 0.5 to 3 mm in length, and (c) 0.03 to 0.09 mm in diameter.

(11) The cosmetic applicator of feature (8), wherein the number of holes in the plurality of holes is from 4 to 8.

(12) The cosmetic applicator of feature (8), wherein the holes in the plurality of holes are not uniform in size.

(13) The cosmetic applicator of feature (8), wherein the holes in the plurality of holes are uniform in size.

(14) The cosmetic applicator of feature (8), wherein the applicator head is curved with an angle between the proximal end and the distal end in the range 90° to 260°.

(15) The cosmetic applicator of feature (8), wherein the cylindrical container is deformable.

(16) The cosmetic applicator of feature (8), wherein the depressible element is a movable piston.

(17) The cosmetic applicator of feature (8), wherein the applicator head is conical.

(18) The cosmetic applicator of feature (17), wherein the interior applicator channel is tapered.

What is claimed is:

1. A cosmetic applicator comprising:

a deformable container configured to store a cosmetic composition;

an applicator head having a linear or non-linear shape with a proximal end and a distal end, and a plurality of holes along a length of the applicator head, the distal end connected to the container; and a flocked brush extending along the applicator head covering at least a portion of the plurality of holes, wherein a spacing distance between adjacent holes of the plurality of holes changes along the length of the applicator head.

2. The cosmetic applicator according to claim 1, wherein the flocked brush covers the entirety of the plurality of holes.

3. The cosmetic applicator according to claim 1, wherein the flocked brush is made of a material having (a) 1.5 to 90 dtex, (b) 0.5 to 3 mm in length, and (c) 0.03 to 0.09 mm in diameter.

4. The cosmetic applicator according to claim 1, wherein the number of holes in the plurality of holes is from 4 to 8.

5. The cosmetic applicator according to claim 1, wherein the holes in the plurality of holes are not uniform in size.

6. The cosmetic applicator according to claim 1, wherein the holes in the plurality of holes are uniform in size.

7. The cosmetic applicator according to claim 1, wherein the applicator head is curved with an angle between the proximal end and the distal end in the range 90° to 260°.

8. A cosmetic applicator comprising:

a cylindrical container configured to store a cosmetic composition having a depressible element;

an applicator head having a linear or non-linear shape with a proximal end and a distal end, and a plurality of holes along a length of the applicator head, the distal end connected to the container; and a flocked brush extending along the applicator head covering at least a portion of the plurality of holes, wherein a spacing distance between adjacent holes of the plurality of holes changes along the length of the applicator head.

9. The cosmetic applicator according to claim 8, wherein the flocked brush covers the entirety of the plurality of holes.

10. The cosmetic applicator according to claim 8, wherein the flocked brush is made of a material having (a) 1.5 to 90 dtex, (b) 0.5 to 3 mm in length, and (c) 0.03 to 0.09 mm in diameter.

11. The cosmetic applicator according to claim 8, wherein the number of holes in the plurality of holes is from 4 to 8.

12. The cosmetic applicator according to claim 8, wherein the holes in the plurality of holes are not uniform in size.

13. The cosmetic applicator according to claim 8, wherein the holes in the plurality of holes are uniform in size.

14. The cosmetic applicator according to claim 8, wherein the applicator head is curved with an angle between the proximal end and the distal end in the range 90° to 260'.

15. The cosmetic applicator according to claim 8, wherein the cylindrical container is deformable.

16. The cosmetic applicator according to claim 8, wherein the applicator head is conical.

17. The cosmetic applicator according to claim 16, wherein the plurality of holes are located along a tapered interior applicator channel.

* * * * *